US006138791A

United States Patent [19]

Zanzie

[11] Patent Number: 6,138,791

[45] Date of Patent: Oct. 31, 2000

[54] MUFFLER SLEEVE, AND METHOD AND APPARATUS FOR MANUFACTURING SAME

[75] Inventor: Daniel Edward Zanzie, Plainfield, Ill.

[73] Assignee: Bay Industries, Inc., Green Bay, Wis.

[21] Appl. No.: 09/041,074

[22] Filed: Mar. 10, 1998

[51] Int. Cl.[7] ..... F01N 1/10

[52] U.S. Cl. ..... 181/252; 181/256; 181/272

[58] Field of Search ..... 181/252, 256, 181/258, 264, 265, 269, 272, 282

[56] References Cited

U.S. PATENT DOCUMENTS

| | | | |
|---|---|---|---|
| 2,046,193 | 6/1936 | Spicer | 181/252 |
| 4,324,314 | 4/1982 | Beach et al. | 181/258 |
| 4,513,841 | 4/1985 | Shimoji et al. | 181/252 |
| 4,846,302 | 7/1989 | Hetherington . | |
| 4,930,597 | 6/1990 | Udell . | |
| 5,036,585 | 8/1991 | Schweinfurth | 181/282 |
| 5,092,122 | 3/1992 | Bainbridge . | |
| 5,109,950 | 5/1992 | Lescher . | |
| 5,162,622 | 11/1992 | Malmsten . | |
| 5,461,777 | 10/1995 | Ikeda et al. . | |
| 5,479,706 | 1/1996 | Tamano et al. . | |
| 5,670,756 | 9/1997 | Ohtaka et al. . | |
| 5,705,777 | 1/1998 | Flanigan et al. . | |
| 5,718,045 | 2/1998 | Tsukahara et al. . | |

*Primary Examiner*—Khanh Dang
*Attorney, Agent, or Firm*—Michael L. Winkelman; Thomas D. Wilhelm

[57] ABSTRACT

A free-standing, compressed, hardened porous, resilient sheath of sound absorbing fibrous material for use in silencer or muffler pipes as the intermediate sound absorbing element between the inner perforated and outer sleeve elements of a three-element pipe is formed by (a) wrapping an uncompressed pad of fibrous material containing a thermo-setting hardening agent around a shaped mandrel having outside surface shape and dimensions conforming the outside surface shape and dimensions of the inner three-element muffler pipe, (b) subjecting the wrapped mandrel and sheath of uncompressed material to a pressure sufficient to conform the outside surface of the compressed pad to the inside surface shape and dimensions of the outer muffler pipe sleeve element, and to a temperature sufficient to set the thermo-setting hardening agent; and (c) removing the mandrel. Three-element muffler pipes comprising the hardened porous sheath, mufflers containing the three-element pipes, and methods for making the hardened porous sheaths, three-element muffler pipes, and mufflers are also disclosed.

28 Claims, 8 Drawing Sheets

MUFFLER SLEEVE, AND METHOD AND APPARATUS FOR MANUFACTURING SAME

TECHNICAL FIELD

This invention relates to sound attenuating devices, to pipes for use in such sound-attenuating devices, to compressed fibrous sleeves for use in sound-attenuating devices and the pipes incorporated in such devices, and to a machine and process for manufacturing such compressed fibrous sleeves.

BACKGROUND OF THE INVENTION

Noise attenuating devices or "silencers" or "mufflers" have been known for some time. The devices are used in a variety of applications including mufflers for internal combustion engines and silencers for air compressors, refrigeration compressors and the like. Mufflers known in the art take a variety of forms, but generally conform to devices of the type disclosed in U.S. Pat. No. 4,930,597. Mufflers comprises an outer canister having inlet and outlet pipes. Generally the canister is divided internally into at least three chambers, including an inlet manifold chamber, an outlet manifold chamber, and a central chamber containing the noise attenuation elements. The exhaust gases from the device to be muffled enter the muffler canister and the inlet manifold. From there, the gases pass through one or more, typically two, three, or four muffler pipes to the outlet manifold. The pipes may pass directly through the central chamber of the muffler can, or may be disposed to force the exhaust gases to reverse one or more times as they pass through the central noise attenuation chamber to reach the exhaust manifold.

Typically, in muffler or silencer construction, the muffler pipes contained within the central chamber of the muffler are perforated or otherwise provided with louvres. These pipes are perforated, for either part or all of their length, with part or all of the perforated sections of the pipe being surrounded by a second outer pipe which is typically crimped or welded onto the inner perforated pipe. Exhaust gases can pass in and out of the perforations or openings in the wall of the inner pipe as they traverse the central noise attenuating chamber of the muffler from the inlet manifold to the outlet manifold. Wrapping a sheath of fibrous material around the perforated inner muffler pipe in those regions where it is surrounded by the outer sleeve pipe assists in the attenuation of high frequency noise as the exhaust gases pass through or pulse in and out of the perforated muffler pipe and into the noise-attenuating fibrous sheath. In the instance where the muffler or silencer is to be utilized on internal combustion engines or on machines having hot exhaust gases, the fibrous material making up the noise attenuating sheath must be able to withstand high temperatures. Typically in such applications, materials such as steel wool, stainless steel wool, and glass fiber have been used in muffler construction. Glass fiber is generally preferred because of its superior sound attenuating properties and low cost.

It is a common practice in the fabrication of mufflers or silencers to first produce the inner perforated muffler pipe and then wrap a fibrous mat around the perforated pipe to obtain a snug fit. Next the outer sleeve pipe is slipped over the concentric inner perforated muffler pipe and fiber sheath, and the outer pipe is crimped or welded at its ends to the inner perforated pipe.

The construction of mufflers containing concentric inner perforated pipes and outer sleeve pipes with a fibrous noise attenuating sheath between the two, presents a number of difficulties, however. For effective noise attenuation, it is desirable that the fibrous sheath fit snugly around the inner perforated pipe, with the outer sleeve pipe in turn fitting snugly about the fibrous sheath and that the fibrous sheath be reasonably densely packed to assure effective sound attenuation. The problem arises during manufacture, however, of assuring that the outer diameter of the fibrous sheath is appropriate for fitting snugly inside the outer muffler sleeve pipe. If the glass fiber sheath is of too small an outside diameter, it is a simple matter to slip the outer muffler sleeve pipe over the sheath, but the fit between the fibrous sheath and the outer muffler sleeve pipe is unacceptably loose. The wrapped fibrous sheath may partially unwind to fit against the inner surface of the outer pipe, but the resulting packing of the fibrous sheath is less dense as a result, and noise attenuation is diminished.

On the other hand, if the outer diameter of the fibrous sheath is too large after winding about the inner perforated tube, the outer sleeve pipe of the muffler cannot be slipped over the glass fiber sheath, and the workpiece must be rejected. This problem is exacerbated by the common practice in the industry of one manufacturer fabricating and shipping the inner perforated muffler pipe to a second manufacturer for the step of wrapping the pipe with the fibrous sheath, followed by re-shipment of the inner pipe and sheath assembly to the first manufacturer for affixing the outer sleeve pipe, and final assembly of the muffler. The cost of shipping the inner perforated muffler pipe from one manufacturer to the other and back, merely to use the inner pipe as a mandrel for wrapping the fibrous sheath is wasteful. Moreover, as "just-in-time" inventory control is implemented by more and more manufacturers to lower costs, the method just described causes both the muffler manufacturer and the manufacturer responsible for wrapping the fibrous sheaths to maintain unacceptably high inventories of work-in-progress. Also, the method provides no guarantee that the outer diameter of the fibrous sheath, thus made, will meet the specification required for snug fit inside the outer muffler pipe sleeve when the fiber-wrapped workpiece arrives back at the first manufacturer. Typically there is a high rate of rejection, with the consequence that the inner perforated muffler pipes must once again be shipped for wrapping with the fibrous sheath.

One attempt to solve this problem is described in U.S. Pat. No. 5,461,777 to Ikeda, et al. The patentees describe the manufacture of muffler pipe assemblies by wrapping the sound-absorbing material fibrous mat around the inner pipe, using the pipe as a mandrel. Following this step, leveling or shaving members are pressed against the rotating sheathed perforated pipe to bring the outside diameter down to the inner diameter of the outer pipe sleeve. The outer pipe sleeve is then slipped over the rotating sheathed inner perforated pipe. Subsequent rotation of the inner pipe and sheath in a direction opposite to its direction of winding causes the fibrous sheath to unwind somewhat and fill the space between the inner and outer pipes.

The need, however, still exists in the art for a more efficient and cost effective method of manufacturing muffler pipe assemblies and internal combustion engine mufflers which permits a dense packing of the fibrous noise-attenuating layer between the inner and outer pipes while solving the problem of close dimensional tolerances.

SUMMARY OF THE INVENTION

The present invention addresses this and other problems by providing, in one embodiment a fibrous sheath of sound absorbing material for use as the sound attenuating element disposed between the outer surface of an inner tubular partially-perforated element and the inner surface of an outer tubular sleeve element of a three-element muffler pipe. The sheath comprises a tubular, porous, resilient mat of compressed and hardened fibrous material having inner and outer surfaces. The inner surface of the sheath is fabricated to form a close fit with the outer surface of the inner tubular partially perforated element of the three-element muffler pipe, and the outer surface of the sheath is fabricated to form a close fit with the inner surface of the outer tubular sleeve element of the three-element muffler pipe.

In a second embodiment, the present invention provides a method for manufacturing hardened, resilient, porous fibrous sheaths for use as the intermediate sheath of sound absorbing material disposed in a three-element muffler pipe between an inner perforated tubular element, and an outer tubular sleeve element. The method comprises the steps of (a) applying an incipient hardening material to a portion of a pad of uncompressed porous fibrous material; (b) wrapping the pad of uncompressed fibrous material around a shaped tubular mandrel, having an outside shape and dimensions conforming to the inner perforated tubular element of the muffler pipe, to form a sheath around the mandrel; (c) subjecting the wrapped uncompressed sheath and mandrel to a pressure sufficient to compress the sheath to an outer shape and dimensions conforming to the inner shape and dimensions of the outer muffler sleeve element, and to a temperature sufficient to harden the incipient hardening material, causing the sheath to retain its predetermined inner and outer shapes and dimensions while retaining its porosity and resilience; and (d) removing the mandrel from the hardened, porous sheath thus formed.

In a third embodiment, the invention provides a three-element muffler pipe assembly comprising an inner partially-perforated tubular element, an intermediate sheath of a porous compressed, resilient, hardened fibrous sound absorbing material fitting closely over the inner perforated tubular element, and an outer tubular sleeve element fitting closely over the sheath of fibrous sound absorbing material. The intermediate sheath of porous compressed hardened sound absorbing material is formed by wrapping an uncompressed pad of fibrous material having an applied layer of thermal-setting hardening material around a mandrel, subjecting the wrapped mandrel and uncompressed pad to a pressure sufficient to conform the outer shape and dimensions of the compressed sheath thus formed to the shape and inner dimensions of the outer sleeve element of the muffler pipe assembly, and heating the mandrel and compressed sheath to a temperature sufficient to set the hardening material.

In a fourth embodiment, the present invention provides a method for making a three-element muffler pipe assembly comprising an inner partially-perforated tubular element, an intermediate sheath of a porous compressed, resilient and hardened fibrous sound absorbing material, fitting closely about the inner tubular element, and an outer tubular sleeve element fitting closely about the intermediate sheath of sound absorbing material. The method comprises the steps of (a) applying an incipient hardening material to a portion of a pad of uncompressed porous fibrous material; (b) wrapping the pad of uncompressed fibrous material around a shaped tubular mandrel, having an outside shape and dimensions conforming to the inner perforated tubular element of the muffler pipe, to form a sheath around the mandrel; (c) subjecting the wrapped uncompressed sheath and mandrel to a pressure sufficient to compress the sheath to an outer shape and dimensions conforming to the inner shape and dimensions of the outer muffler sleeve element, and to a temperature sufficient to harden the incipient hardening material, causing the sheath to retain its predetermined inner and outer shapes and dimensions while retaining its porosity and resilience; and (d) removing the mandrel from the hardened, porous sheath thus formed (e) inserting the inner perforated tubular element into the porous hardened fibrous sheath; and (f) slipping the close-fitting outer tubular sleeve element over the hardened porous fibrous sheath.

In a fifth embodiment, the present invention provides a sound attenuating muffler comprising an outer canister having first and second end walls, and lateral walls dividing the canister into at least three compartments or chambers comprising an inlet manifold chamber, a central sound-attenuating chamber, and an outlet manifold chamber. At least one sound attenuating pipe extends from the inlet manifold chamber through an aperture in the dividing lateral wall between the inlet manifold chamber and the central sound-attenuating chamber and into the central sound-attenuating chamber; and at least one sound attenuating pipe extends from the central sound attenuating chamber through an aperture in the dividing lateral wall between the central sound attenuating chamber and the outlet manifold chamber into the outlet manifold chamber. The pipes comprise a three element muffler pipe having an inner partially-perforated tubular element, an intermediate sheath of a porous compressed, resilient, hardened fibrous sound absorbing material fitting closely over the inner perforated tubular element, and a outer tubular sleeve element fitting closely over the sheath of fibrous sound absorbing material. The intermediate sheath of porous compressed hardened sound absorbing material is formed by wrapping an uncompressed pad of fibrous material having an applied layer of thermal-setting hardening material around a mandrel, subjecting the wrapped mandrel and uncompressed pad to a pressure sufficient to conform the outer shape and dimensions of the compressed sheath thus formed to the shape and inner dimensions of the outer sleeve element of the muffler pipe assembly, and heating the mandrel and compressed sheath to a temperature sufficient to set the hardening material.

DESCRIPTION OF THE DRAWING FIGURES

Figure 5:
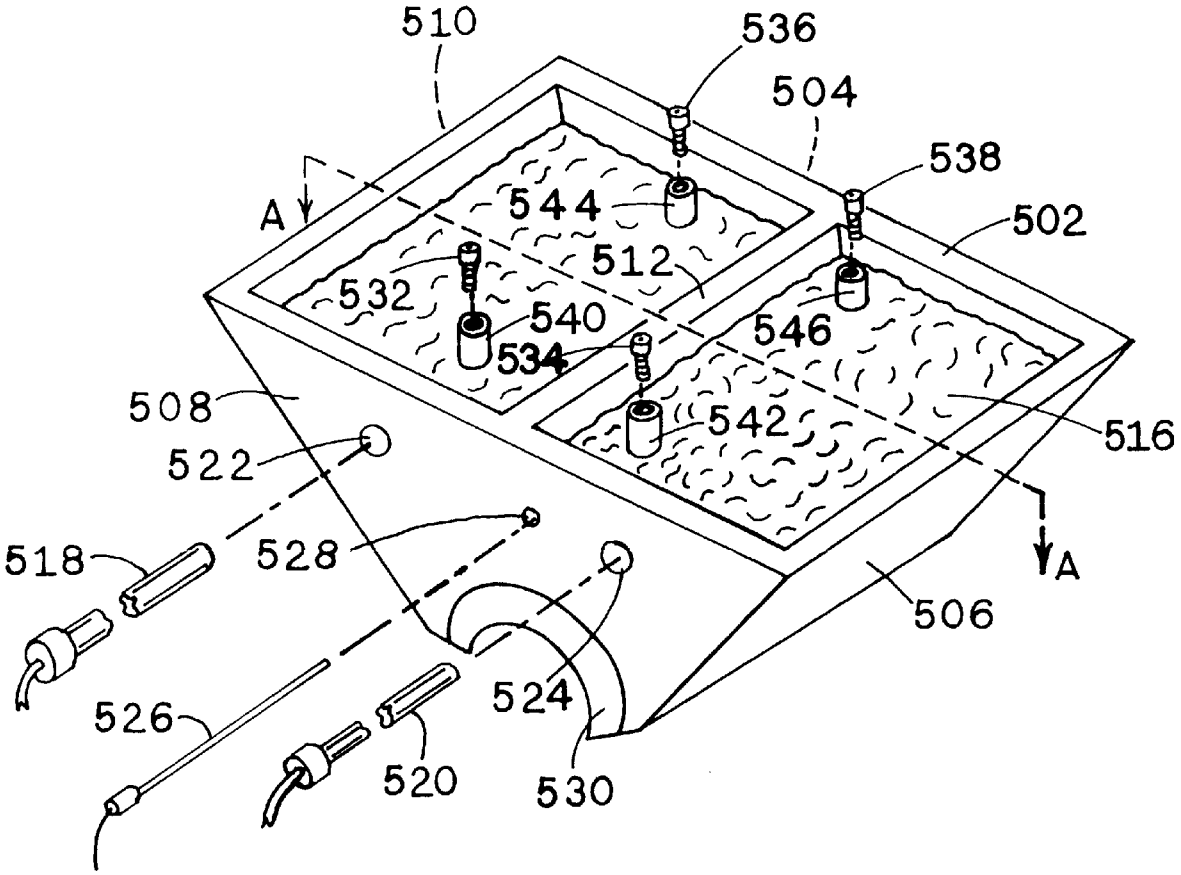

FIG. 5 presents an exploded view of one of the pressing elements employed in the machine of the invention.

Figure 6:
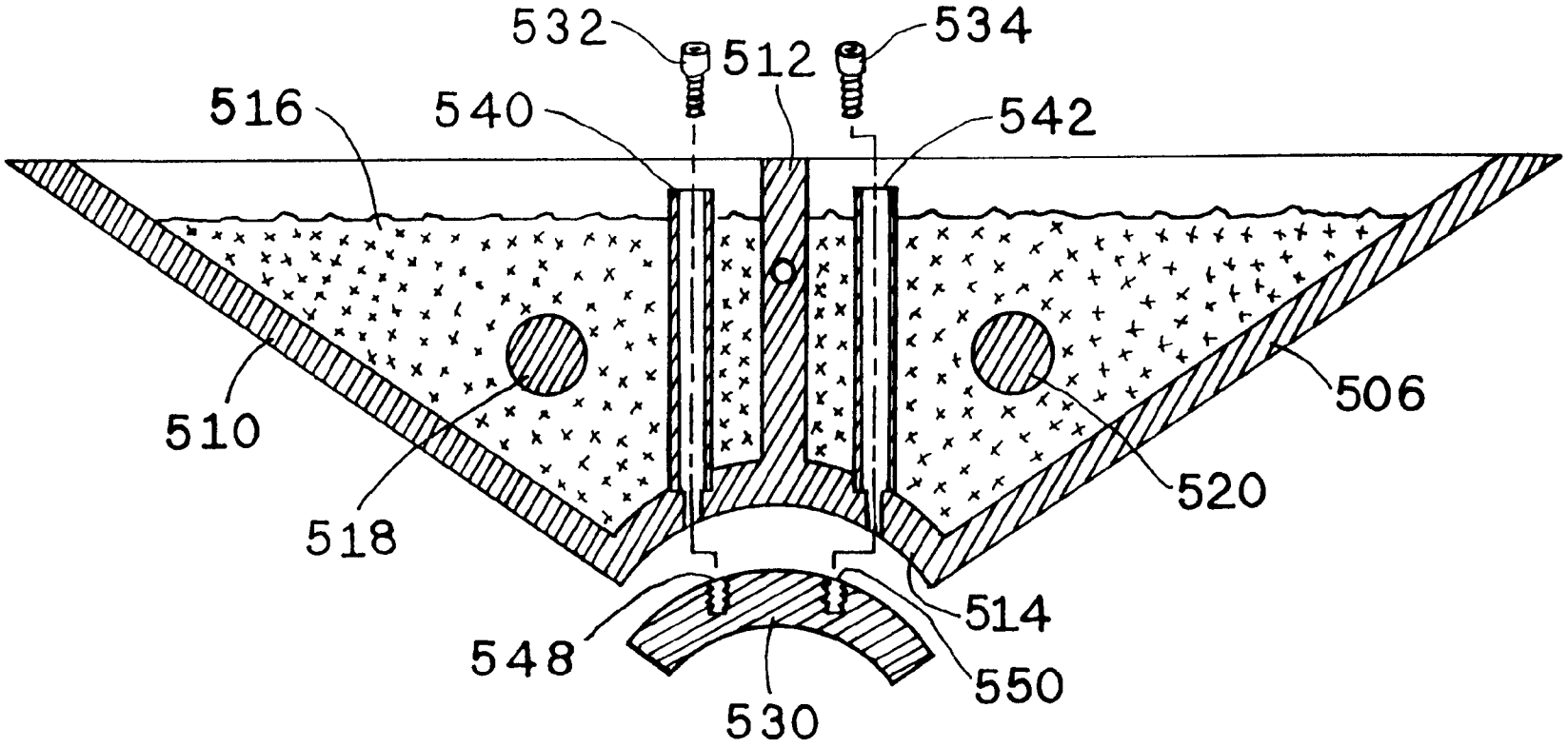

FIG. 6 presents a sectional view of one of the pressing elements employed in the machine of the invention, taken along cut line A—A.

Figure 7:
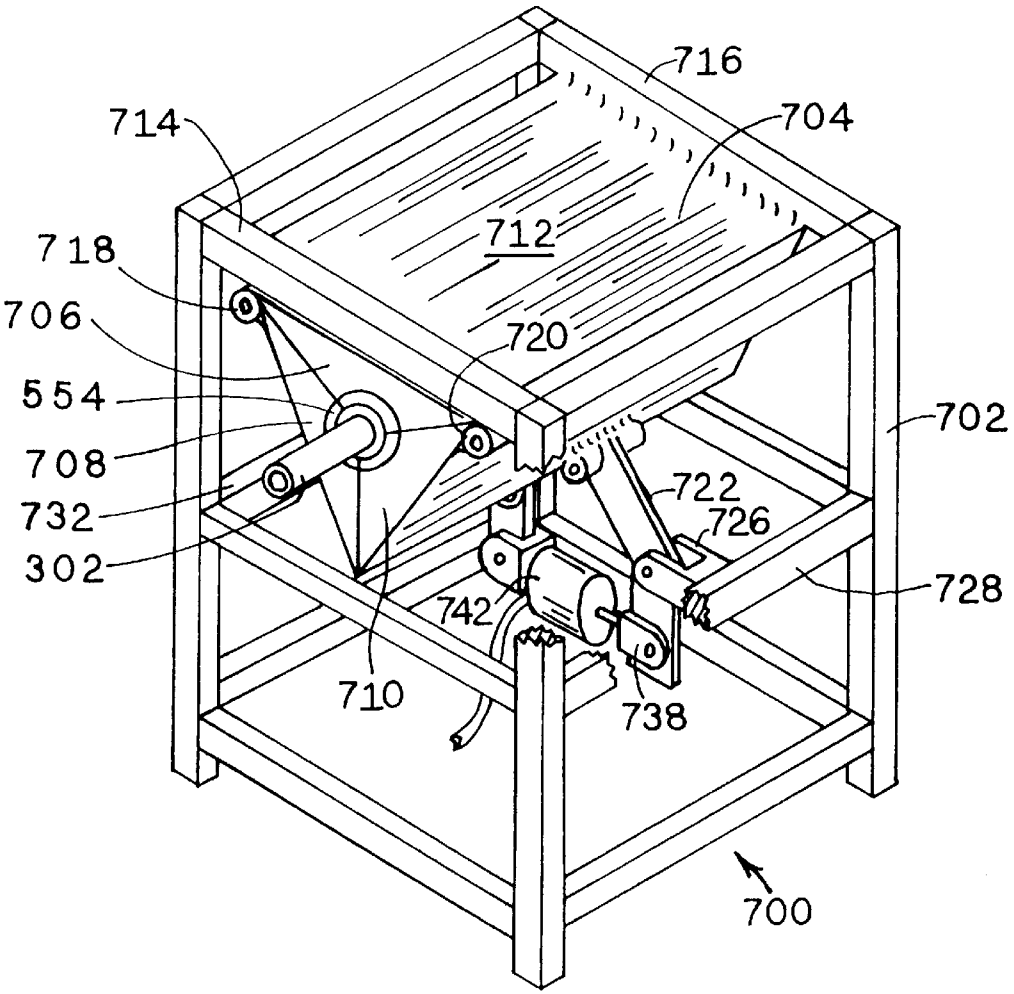

FIG. 7 represents a perspective view of the machine of the invention.

Figures 8A, 8B, 8C:
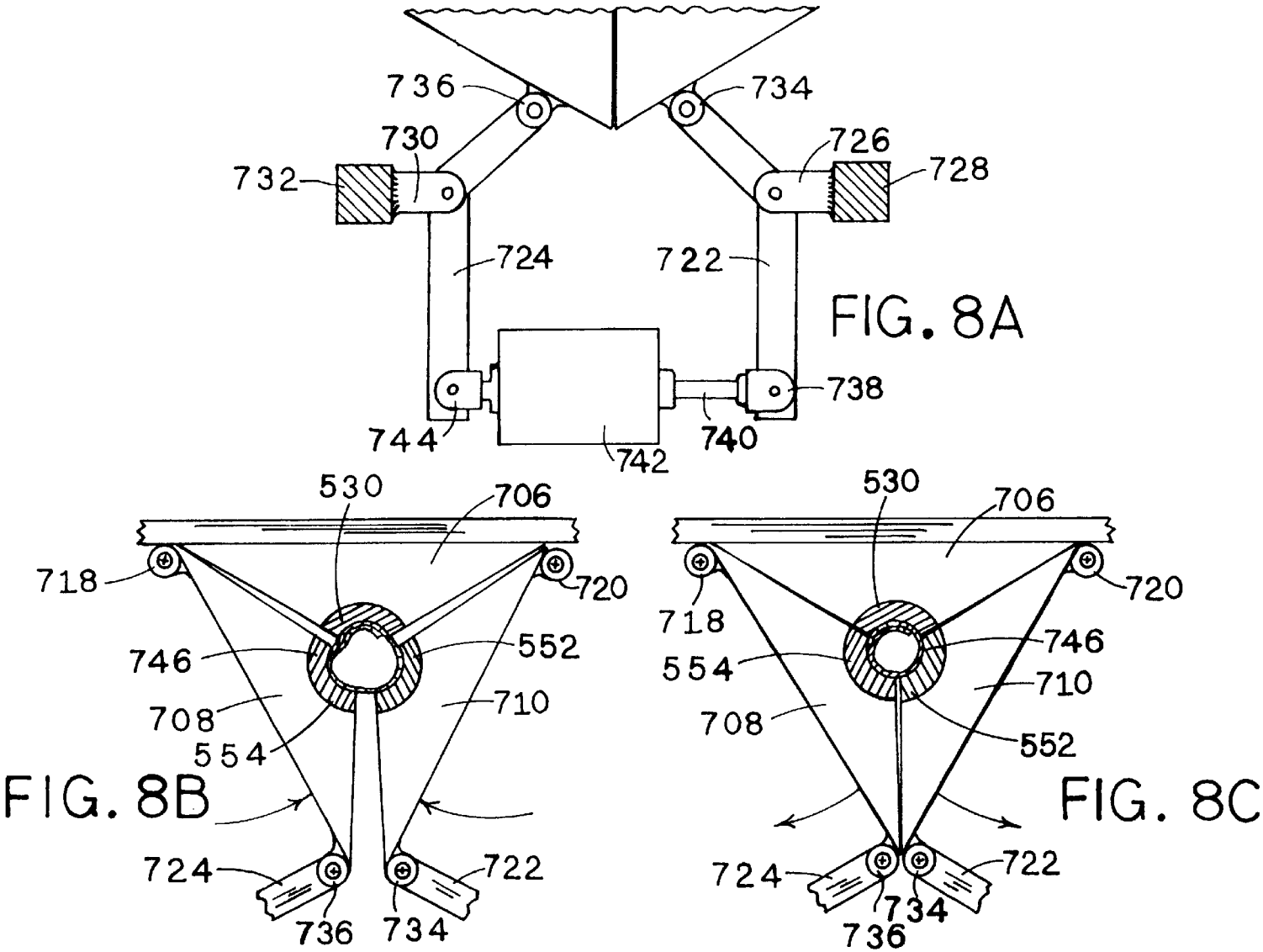

FIGS. 8(A–C) represent elements of the machine of the invention showing the pressing elements of the machine in an open configuration (FIG. 8B), a closed position (FIG. 8C) and in FIG. 8A, the actuating mechanism for opening and closing the pressing elements of the machine.

Figure 9:
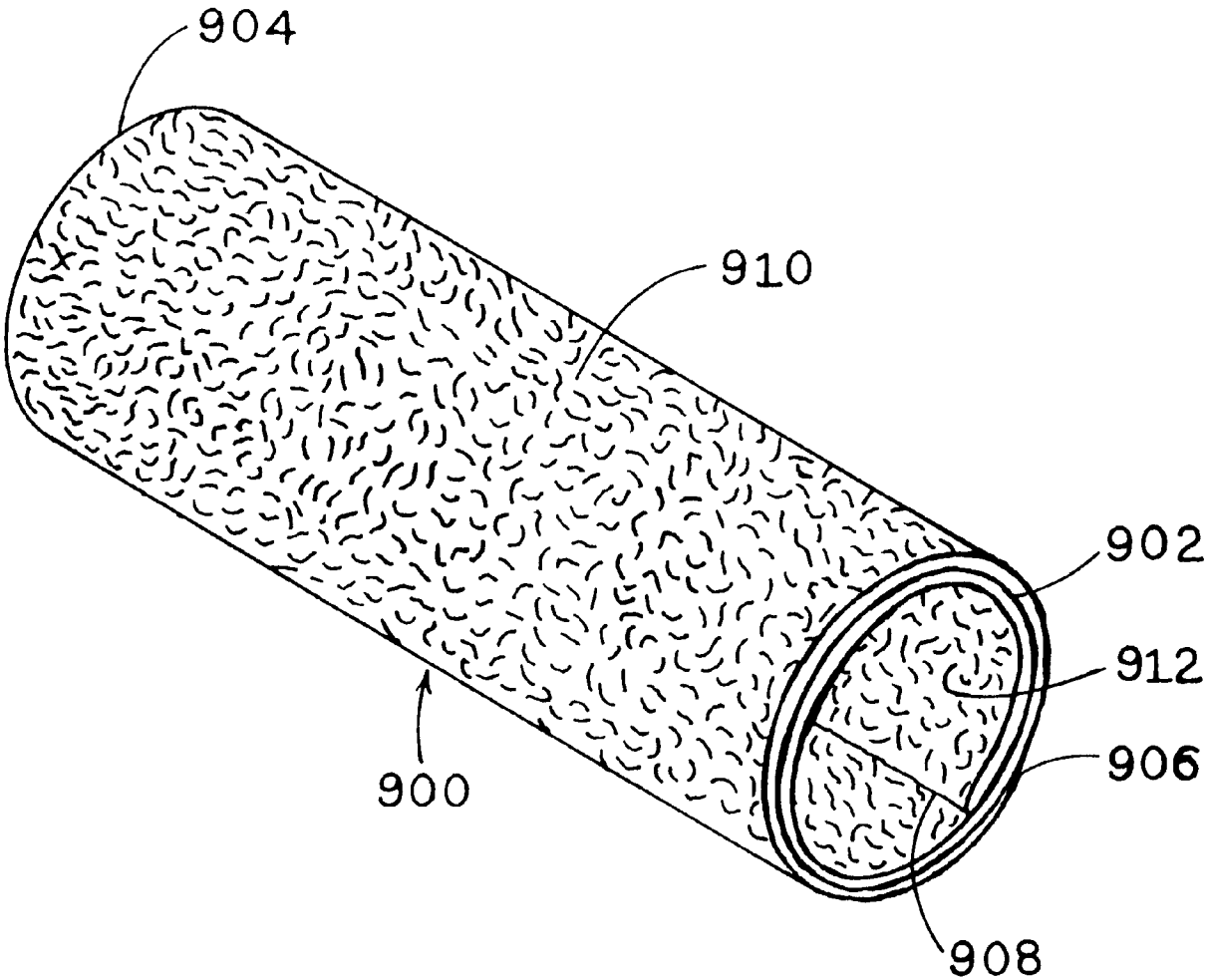

FIG. 9 presents a perspective view of a hardened, porous, resilient, fibrous sheath of the invention for use in three-element muffler pipes.

Figure 10B:
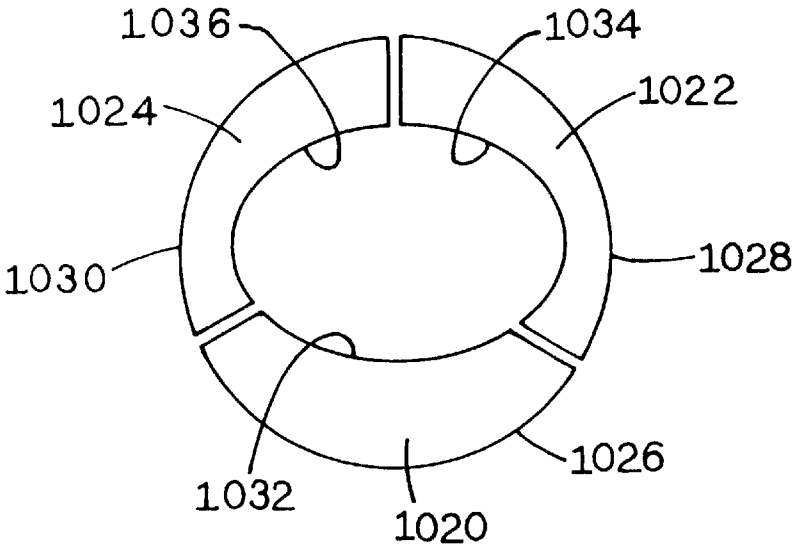
Figure 10A:
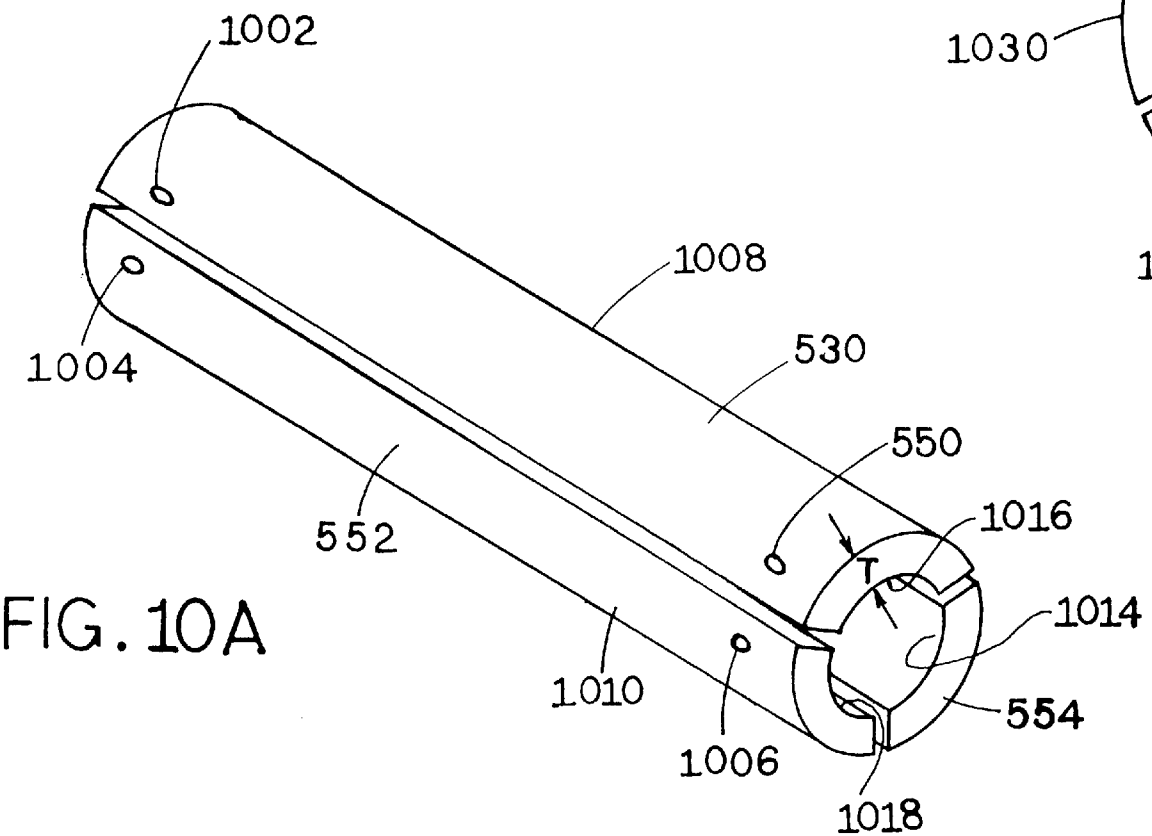

FIGS. 10(A–B) depict the facing elements of the dies used in the machine for fabricating sound-attenuating fibrous sheaths of the invention. In FIG. 10A, the sections of the facing elements having right circular cylindrical inner and outer surfaces are shown in perspective view. In FIG. 10B shows an alternative embodiment of the die facing elements in end view.

DETAILED DESCRIPTION

A machine for making the tubular compressed porous sound absorbing sheaths for muffler pipe assemblies of the present invention is shown in FIGS. 7 and 8. The machine 700 comprises a table or support structure 702. The supporting structure 702 is shown in the embodiment depicted as a structure of legs and cross braces which may be fabricated of welded or bolted steel or other suitable metal having the requisite strength and rigidity. One leg of the structure is shown cut-away in FIG. 7 so that other elements of the machine can be viewed clearly.

A three-element pressing apparatus 704 is shown affixed to the supporting structure 702. The pressing apparatus comprises three elements 706, 708, and 710 each having the shape of a right prism with a triangular base and rectangular side walls. Element 706 is firmly affixed to the support structure 702 at the upper surface 712 of the element 706 by any conventional means known to the machinist such as bolting, welding, or the like. Pressing element 708 is hingedly attached by means of hinge 718 to upper frame elements 714 and 716 or to pressing element 706 in such a manner that element 708 can swing away from pressing element 706. The hinging means can comprise a single hinge running the length of a rectangular side wall of element 708 or can comprise two shorter hinges, one at each end of the side wall of element 708, or a number of shorter hinges disposed in a spaced-apart manner along the side wall of element 708. The hinge or hinges are attached to pressing element 708 and to either the upper frame elements 714 and 716 or to pressing element 706 by conventional means such as bolts or welding. In a similar manner, pressing element 710 is hingedly attached by means of hinge or hinges 720 either to upper frame elements 714 and 716 or to pressing element 706 so that element 710 can swing away from pressing element 706.

The movement of pressing elements 708 and 710 relative to pressing element 706 can be more readily seen in FIGS. 8B and 8C. In FIG. 8C the three-element pressing apparatus is shown in its closed position. Pressing elements 708 and 710 rotate around the axis of hinges 718 and 720, respectively in the direction of the arrows. In FIG. 8B, the three-element pressing apparatus is shown in its open position.

Referring again to FIG. 7, machine 700 is provided with two angled lever arms 722 and 724, the latter being partially hidden in the view presented in FIG. 7, but more clearly seen in FIG. 8A. Angled lever arm 722 is hingedly attached at its fulcrum to support structure element 728 by means of yoke 726. In a similar manner, angled lever arm 724 is hingedly attached at its fulcrum to support element 732 by yoke 730. The complete structure can be seen more clearly in FIG. 8A. As shown in FIG. 8A, the upper end of angled lever arm 722 is connected to hinge 734 which, in turn, is firmly affixed to pressing element 710. Similarly, the upper end of angled lever arm 724 is connected to hinge 736 which, in turn, is attached to pressing element 708.

The bottom end of angled lever arm 724 is hingedly attached to yoke 738 which, in turn, is firmly attached to the moveable shaft 740 of hydraulic cylinder 742. Yoke 744 is firmly attached to hydraulic cylinder 742 and hingedly attached to the bottom end of angled lever arm 724. Hydraulic cylinder 742 is suspended between the lever arms 722 and 724 and acts to open and close pressing elements 708 and 710. When hydraulic cylinder 742 is pressurized, moveable shaft 740 moves outwardly and acts through angled lever arms 722 and 724 to produce a scissor-like action closing pressing elements 708 and 710. When pressure is released from hydraulic cylinder 742, moveable shaft 740 moves inwardly and acts through angled lever arms 722 and 724 to produce a scissor-like action to open pressing elements 708 and 710.

The three pressing elements 706, 708, and 710, are essentially identical, except for the means by which they are attached to one another, to the support structure 702, or to the angled lever arms 722 and 724 as discussed above. Details of the three similar pressing elements 706, 708, and 710 can be seen in FIGS. 5 and 6 where features of pressing element 706 are shown by way of example.

FIG. 5 shows one of the three elements which comprises a cast metal structure 502 which comprises a box having inwardly sloping substantially rectangular side walls 506 and 510 with end walls 504 and 508. A curving bottom wall 514, not seen in FIG. 5 joins side walls 506 and 510 with end walls 504 and 508. A web 512 divides the box and connects the insides of end walls 504 and 508 and curving bottom wall 514. The cross section of box structure 502, taken along cut line A—A is shown in FIG. 6 where the sloping side walls 506 and 510, web 512 and curved bottom wall 514 can be seen in cross-section.

Referring again to FIG. 5, the box-like casting 502 is filled with a heat-conducting cement 51. Heating elements 518 and 520 are embedded in heat-conducting cement 516, through holes 522 and 524 in wall 508 to supply heat to pressing element 706. A thermocouple 526 is inserted into web 512 through a hole 528 drilled through wall 508 and into web 512 to continually monitor the temperature of the pressing element during operation.

A curved facing plate 530 is attached to the bottom wall 514 of the box structure 502 by means of bolts 532, 534, 536, and 538 passing through access tubes 540, 542, 544, and 542, respectively. The curved facing plate 530 is a longitudinal section of a tube, preferably having the same length as the pressing element to which it attached, and may be fabricated of aluminum, brass, steel, stainless steel or any other machineable metal of appropriate hardness. Although aluminum is most easily machined, it is not as preferred as the harder metals such as brass, steel, or stainless steel. Steel and stainless steel are particularly preferred for the facing plate 530 because the hardness of these materials withstands scoring when the piece of spirally-wound shim stock (discussed below) is removed and re-inserted.

Referring to FIG. 6, the means by which facing plate 530 is attached to the lower surface of curved bottom wall 514 is readily apparent. In the cross section along line A—A shown, bolts 532 reaches threaded hole 548 in facing plate 530 through access tube 540. Similarly, bolt 534 reaches threaded hole 550 in facing plate 530.

Referring to FIG. 10A, in one embodiment of the machine, the facing plates 1000 comprise machined longitudinal sections of a circularly cylindrical tube. When the three sections 530, 552, and 554, are closed upon one another, the outer surfaces 1008, 1010, and 1012 form a circularly cylindrical surface which fits tightly against the inner curved walls of the three pressing elements 706, 708, and 710. Similarly, when the three sections 530, 552, and 554, are closed upon one another, the inner surfaces 1014, 1016, and 1018 form a circularly cylindrical surface. The wall thickness t of the tube which is sectioned longitudinally to form the facing elements 530, 552 and 554 is chosen so as to fit inside surfaces of the pressing elements 706, 708, and 710 and to define a diameter, when the three sections 530, 552 and 554 are closed upon one another, which is roughly that of the outside diameter of the final compressed and hardened muffler or silencer sheath.

The inside surface 1014, 1016 and 1018 of the die facing elements 530, 552 and 554 need not define a circular cylinder, however, as shown in the alternative embodiment depicted in FIG. 10B. In FIG. 10B the three die facing elements 1020, 1022 and 1024 are shown in end view and have respective outer surfaces 1026, 1028, and 1030 which form, when the three elements are closed upon one another, a circularly cylindrical surface. The outer surfaces 1026, 1028, and 1030 fit tightly against the curved inner surfaces of pressing elements 706, 708, and 710 in the manner described above. However, the inner surfaces 1032, 1034, and 1035, of the die facing elements 1020, 1022 and 1024 as shown in the embodiment in FIG. 10B form, when the three elements are closed upon one another, an elliptically cylindrical surface. The compressed, hardened fibrous muffler or silencer tube sheaths produced by die facing elements 1020, 1022, and 1024 thus have an outer surface, 910 in FIG. 9, defining an elliptical cylinder. The inside surface, of the sheath, 912 in FIG. 9, has the shape and dimensions of the mandrel upon which the sheath was initially wound s described below.

It is thus possible, by changing the inside surface dimensions and shape of the die facing elements to produce compressed, hardened fibrous muffler or silencer tube sheaths of any desired diameter or cross-sectional shape. For example, by using a circularly cylindrical wrapping mandrel and die facing elements which, when closed, define a circularly cylindrical surface, sheaths which comprised a cylindrical tubular cylinder can be produced. Similarly, with a wrapping mandrel of elliptical cross-section and die facing elements which define, when closed upon one another, an elliptical cylindrical surface, sheaths having inner and outer surfaces which both define cylinders of elliptical cross-section. In such a situation, the major axis of the cross-sectional ellipse of the mandrel can be turned through any desired angle from 0° to 90° with respect to the major axis of the cross-section of the elliptical cylinder formed by the closed facing elements 530, 552, and 554, although it is preferred that the major axes of the two elliptical cross-sections be substantially coincident.

In a like manner, one of the inner or outer surfaces of the finished sheath may be circular in cross-section, with the other being elliptical in cross-section, as desired by appropriate selection of the cross-sectional shape of the mandrel and the shapes of the die facing elements 530, 552, and 554.

As described above, the facing elements 530, 552 and 554 of the pressing die elements 706, 708, and 710 are each bolted inside their respective pressing or die elements 706, 708, and 710 as shown in the cross-section in FIG. 6. This permits the easy interchange of elements of differing inside dimensions and shapes to be change on the machine.

In FIG. 7, the machine of the invention is shown with the pressing elements 706, 708, and 710 in the closed position and with a workpiece in place. The workpiece comprises mandrel 302 and a sheath of fibrous sound absorbing material 316. It is clear that, without some means of providing otherwise, the seams where pressing elements 706, 708, and 710 meet would tend to form ridges or seam lines along the length of the compressed and hardened porous sheath 750 upon opening the pressing apparatus. To achieve a smooth surface on the compressed and hardened porous sheath, a sheet of resilient or "springy" metal such as spring steel or stainless steel, rolled into a spiral tube is inserted into the opening formed by the three facing plates 530, 552, and 554. This can best be seen in FIG. 8B where the three elements 706, 708, and 710 of the pressing apparatus are shown in the open position and the spirally coiled sheet of resilient metal is shown as element 746. The preferred material for the spirally-wound sheet of metal is shim steel commonly available in the trade.

The sheet of resilient metal is preferably of a thickness of about 0.005 inches to 0.015 inches, most preferably about 0.010 inches, and is cut to a length corresponding to the length of the pressing elements 706, 708, and 710, and a width such that the two edges of the sheet, when wound into a spiral and inserted in the open pressing apparatus overlap slightly. When the pressing apparatus is closed, as shown in FIG. 8C, the two edges of the resilient sheet of metal slide past one another. Since the thickness of the metal is quite small with respect to the thickness of the hardened porous sheath 750, no detectable seam line remains in the sheath 750 following the pressing and hardening operation.

The steps of the method for manufacturing fibrous sheaths of sound absorbing material for muffler or silencer pipes according to this invention are shown schematically in FIGS. 3A through 3F. A sheet or pad of porous fibrous sound absorbing material is cut to a length L which permits the sheet or pad to be wrapped about a mandrel the desired number of times with enough excess to permit an slight overlap of the second or final roll edge 304 with the first or initial roll edge 306 of the pad 300. The preferred number of laps of winding is two. This overlap is indicated as "d" in FIG. 4 which shows and end-on view of the pad 300 rolled about a mandrel 302 of circular cross-section. This length L of the pad 300 is easily determined once the outside shape and dimensions of the inside perforated pipe of the muffler for which the fibrous, sound-absorbing sheath is intended is known or specified. These specified inner muffler or silencer shape and dimensions become the outside shape and dimensions of winding mandrel 302. Based upon the thickness of the mat or pad 300 of fibrous sound-absorbing material, and the outer dimensions of mandrel 302, the length L is determined by rolling one pad about the mandrel. Once L has been determined in this manner for a given inner muffler pipe, duplicate pads can be cut in any number desired for mass production.

The width W of the pad 300 is determined simply by the length of the inner perforated tube of the for which coverage by the final sound absorbing sheath is desired. It is a useful expedient, however, to select a width W which permits the production of two, three, or more sheaths for the inner perforated muffler pipes in a single operation, and then subsequently cutting the single rolled, hardened, and compressed sheath to the desired length(s).

The pad of porous fibrous sound-absorbing material may be made of any suitable filamentous material including fibrous mats of polyethylene, polypropylene, polytetrafluoroethylene or other polymeric material or, in those cases where the muffler is to be used in applications where the exhaust gases passing through it are hot, any material capable of withstanding high exhaust gas temperatures to which the final muffler pipe sheath will be subjected. In the latter instance, the fibrous pad or mat may be made of, for example, steel wool, stainless steel wool, or other suitable metal wool, or glass wool. Because of its low cost and suitability to the task, glass wool is the preferred material. Although the "coarseness" of the fibrous glass wool can vary, depending upon the application in which the final compressed muffler sheath is to be used, a needled felt glass wool of uniform filament diameter of about 5 microns is preferred and is commercially available, for example, as "Techmat" from BGF Industries, 3802 Robert Porcher Way, Greensboro, N.C., 27410. The thickness of glass wool pad or sheeting is typically indicated by giving the weight per square foot of the material. The thickness of glass wool pad required for muffler or silencer pipe sound deadening sheaths will vary with the muffler and particular degree of sound deadening desired. However, a glass wool pad thickness of about 1 ounce (15. gm) per square foot (per 0.093 square meter) is preferred in the method and article of manufacture of this invention.

Figures 3A, 3B, 3C, 3D, 3E, 3F:
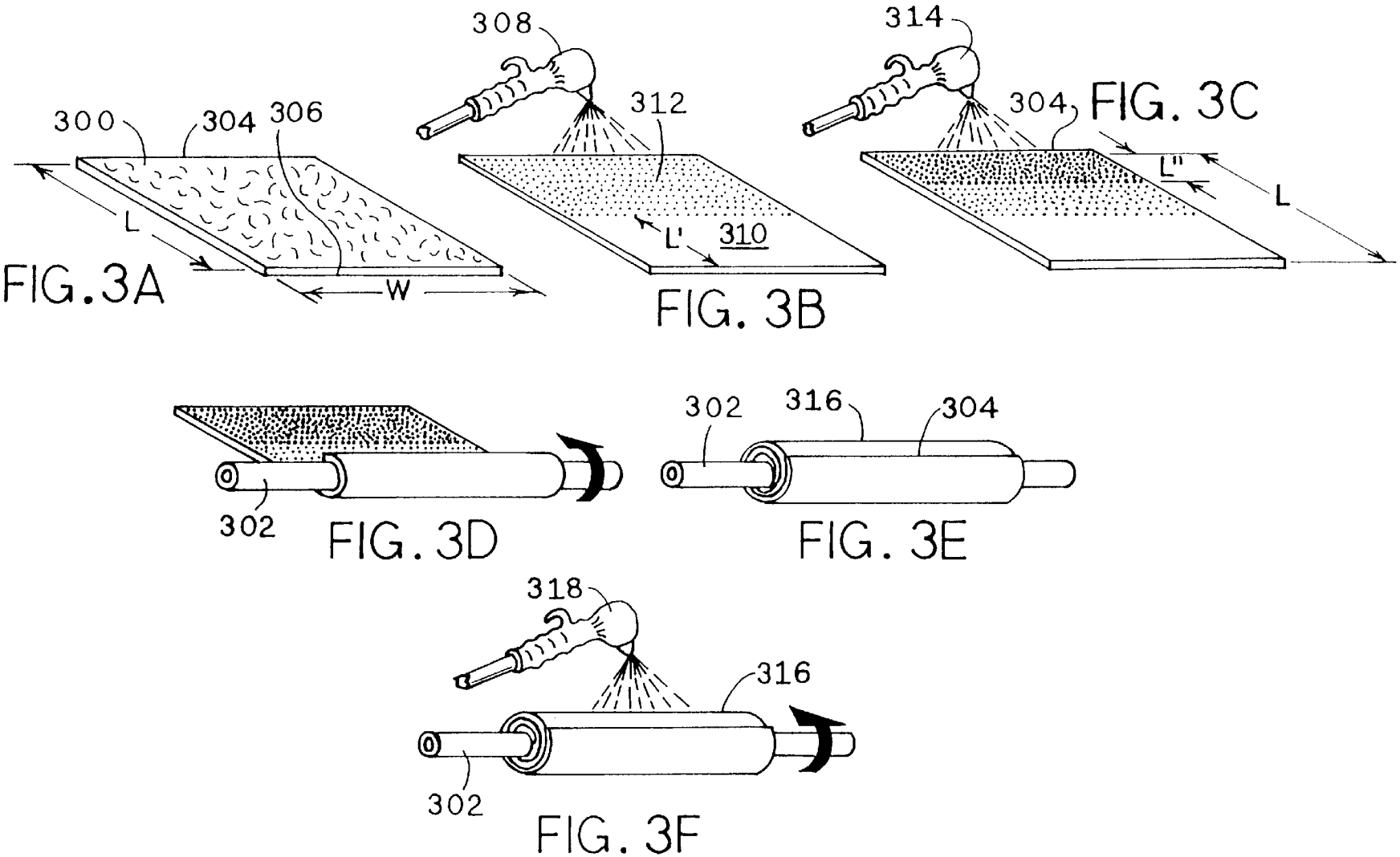
FIGS. 3(A–F) illustrate steps in the method of forming porous, hardened, resilient, sound-attenuating muffler or silencer pipe sheaths of the invention.
Figure 4:
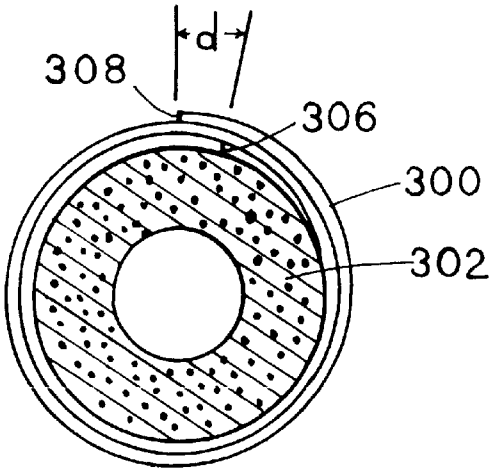
FIG. 4 represents a cross-sectional view of sound-attenuating muffler pipe sheaths of the present invention.

In FIG. 3B, the operation of applying the incipient hardening material or agent to the pad is illustrated. By the term "incipient hardening material or agent" is meant a material which is initially fluid, but which is thermo-setting; that is, in the subsequent heating and pressing operations, a material which is converted by the action of heat to a hardened state. In mufflers employed with internal combustion engines, the hardening material or agent must be capable of withstanding the high temperatures of exhaust gases from such engines. In the case where the pad 300 of porous sound absorbing material is a pad or mat of glass fiber, a mixture of metal salts of silicic acid, and kaolin clay is used. A water solution of sodium silicate, commonly called "water glass" and kaolin clay is preferred as the incipient hardening agent. While not holding to one theory to the exclusion of others, it is believed that during the heating and pressing steps of the method (discussed in more detail below), the silicate and clay mixture bonds the fibers of the porous glass fiber to form a more or less rigid network of the glass fibers which remains porous and resilient. By the term "resilient" is meant that the finished hardened and porous tubular sheath can be slightly deformed by squeezing between the fingers, but rebounds quickly to its original shape and dimensions once pressure is released.

Referring again to FIG. 3B, it can be seen that the incipient hardening agent is applied, most conveniently by spraying, to only a portion of the pad 300 of porous sound absorbing material. Preferably, the length of the region 310 of pad 300 to which the fluid incipient hardening agent is applied, measured opposite to the direction of rolling of the pad 300 about the mandrel 302, corresponds roughly to the length L of the pad, less the distance L' corresponding to about one revolution of the mandrel 302 about its major axis. Again, while not holding to one theory to the exclusion of others, it is believed that this step prevents adherence of the finished sheath to the mandrel and aids in easy removal of the final hardened and compressed sheath from the mandrel as will be discussed later.

Following the step of application of the fluid incipient hardening agent to the pad, the coating of incipient hardening agent is allowed to air dry at ambient temperature. In the next step of the method shown in FIG. 3C, sprayer 314 is used to apply a tackifying or adhesive agent over the layer of air-dried incipient hardening agent 312. The size of the area of application of the tackifying agent is not critical, and typically comprises a band of length L" near the second or final roll edge 304 of the pad which is about ⅕ to about ⅓ of the length L, preferably about ¼. The purpose of the application of the tackifying or adhesive agent is to hold the second or final roll edge 304 in place in the final rolled assembly shown in FIG. 3E until the heating and compressing operation can be completed.

The tackifying or adhesive agent can be any suitable commercially available polymer or resin-based adhesive agent. A preferred tackifying or adhesive agent is a styrene-isoprene copolymer such as "Misty" multi-purpose adhesive manufactured by Amrep, Inc. 990 Industrial Park Drive, Marietta, Ga. 30062.

In the next step of the method, shown in FIG. 3D, the pad having the applied layers of dried incipient hardening agent and tackifier or adhesive is rolled about the mandrel 302 in the direction shown by the heavy arrow, that is, with the applied layers of incipient hardening agent and tackifier or adhesive inside the roll. The final non-hardened and uncompressed sheath 316, rolled about the mandrel 302 is shown in FIG. 3E. The tackifier or adhesive firmly holds the second or final roll edge 304 against the remainder of the rolled sheath 316 for subsequent processing of the sheath.

The mandrel may be of any suitable material which will neither expand nor contract appreciably during the various processing steps including the heating and compression steps of the process. In addition, the mandrel must be of a material of sufficient structural integrity to withstand the heat and pressure to which it and the fibrous pad wrapped around it are subjected in the heating and compression steps. It is preferably made also of a poor conductor of heat to permit handling by operators during the manufacturing process. For this reason, although metal mandrels may be used, they tend to become literally "too hot to handle" during the manufacturing process and are not preferred. Thermoplastic materials are not capable of withstanding the temperatures required in the heating and compression steps, and typically it is difficult to remove the finished hardened and compressed porous fibrous sheath from wooden dowels used as the mandrel. The preferred mandrel material is a heavy-walled paperboard or fiberboard tube, having the desired outside dimensions and shape and a wall thickness of at least about one-quarter inch. Mandrels made of such material have the combined desirable properties of strength, resistance to high temperature, and low heat conductivity. In addition, it has been found that glass fiber sheaths formed around a tubular paperboard or fiberboard mandrel by heat compression are easily removed from the mandrel.

In an optional step of the method, shown in FIG. 3F, a sprayer 318 is used to apply a light coat of soluble starch to the outer surface of the rolled sheath 316 while to sheath 316 and mandrel 302 are rotated. While not holding to one theory to the exclusion of others, it is believed that the starch application serves to provide a smoother finish on the outer surface of the final hardened and compressed sheath and to hold down glass fibers which might otherwise become airborne and provide a nuisance while handling the sheath during subsequent muffler assembly operations.

Following the application of soluble starch to the outer surface of the uncompressed porous fibrous sheath, the mandrel and sheath assembly is inserted into the machine of this invention for the steps of heating and compression. Referring to FIG. 7, the machine 700 is shown with the mandrel 302 with the wrapping of uncompressed fibrous sheath 316 in place in the cavity formed by the pressing blocks or elements 706, 708, and 710. The pressing blocks or elements 706, 708, and 710 have been pre-heated to a temperature sufficient to harden the insipient hardening agent rolled inside the unhardened sheath 316, typically a temperature in a range of between about 500° F. (260° C.) and about 750° F. (400° C.), preferably about 600° F. (316° C.) to about 675° F. (358° C.). Hydraulic cylinder 742 is pressurized and both heat and pressure are applied for a period of time sufficient to harden the insipient hardening agent and to compress the uncompressed sheath to the desired outside diameter. At a temperature of about 650° F., a time of between about 1 to about 5 minutes, typically about 2 to 3 minutes is sufficient to produce the desired results. The temperature of the pressing blocks or elements 706, 708, and 710 is monitored by means of the thermocouple 526 inserted in each block.

While the pressure applied by hydraulic cylinder 742 can easily be monitored by attaching a pressure gauge to the cylinder, the actual force applied to rotatable pressing elements 708 and 710 depend upon a number of factors including the piston size of the hydraulic cylinder, and the lengths of the lever arms 722 and 724 as they turn about the fulcrum points represented by yokes 726 and 730. However, it is a simple procedure to run a few "test" compressions to determine the optimum operating conditions of gauge pressure for obtaining the desired final compressed sheath outer diameter.

Once the fibrous sheath is hardened and compressed, the hydraulic cylinder 742 is depressurized to move the pressing blocks 708 and 710 away from one another as shown in FIG. 8B and release the mandrel 302 and the compressed and hardened muffler pipe sheath 900. The ends 902 and 904 of the hardened and compressed sheath 900, shown in FIG. 9 removed from the mandrel 302, are trimmed, for example by a saw. If needed or desired, the finished hardened and compressed sheath 900 is cut into desired lengths.

The final hardened compressed sheath 900 has considerable structural integrity while retaining porosity and resilience. The sheath 900 is light weight and can readily be shipped without damage. The seams 906 and 908 corresponding, respectively, to the second final roll edge 304 and first, or initial roll edge 306, of the pad have been compressed into the hardened sheath 900 by the heating and compression steps so as to leave no discernible seam or ridge along either the inside 912 or outside 910 surfaces of the sheath. The outside surface 910 of the hardened and compressed sheath 900 is smooth and is uniform in dimensions. Both the inside and outside diameters of the hardened and compressed sheath 900 are reproducible within a variability of ±0.01 inch.

Figure 2:
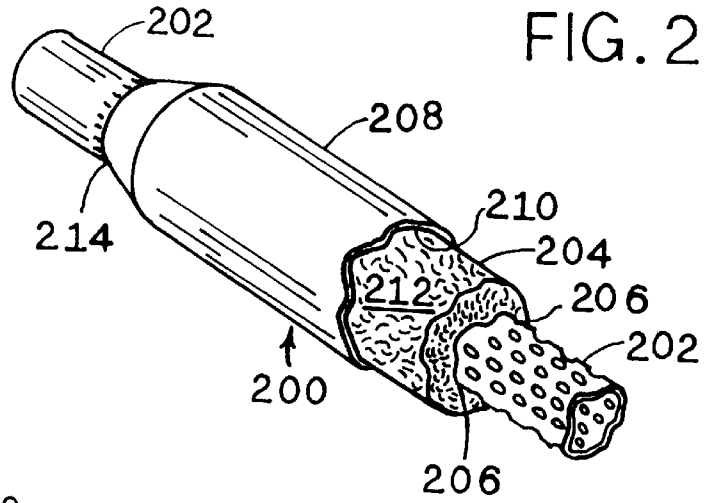
FIG. 2 is a partially cut-away representation of a three-element sound-attenuating muffler or silencer pipe of the invention.

A three element muffler pipe assembly 200 according to one embodiment of the invention is depicted in FIG. 2. A partially perforated inner muffler tube 202 is surrounded by a close-fitting hardened, porous, resilient, fibrous sheath 204 which surrounds the inner partially-perforated tube 202, the inner surface 206 of the sheath 204 fitting snugly against the outer surface 206 of the inner partially-perforated muffler tube 202.

An outer tubular sleeve 208 fits over the sheath 204, the inner surface 210 of the outer sleeve 208 fitting snugly against the outer surface 212 of the sheath.

At one end, the outer sleeve 208 is shown affixed to the partially-perforated inner tube 202 at crimp or weld 214. The method of affixing outer sleeve 208 to inner tube 202 is conventional in the art and may be by crimping or welding.

Figure 1:
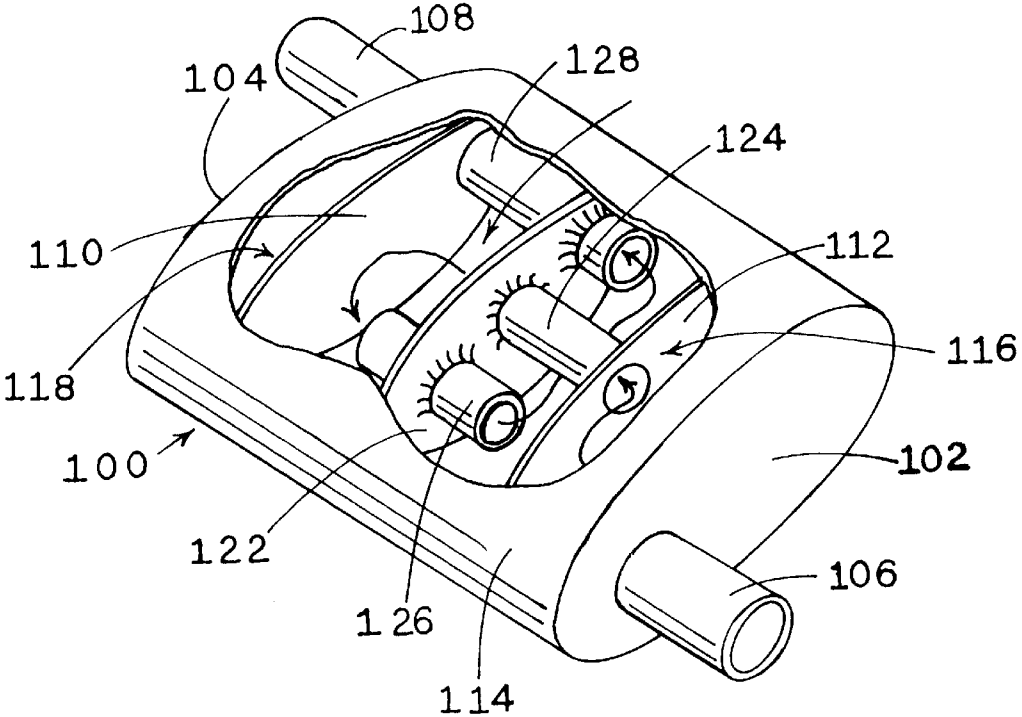
FIG. 1 is partially cut-away representation of a sound-attenuating muffler.

A muffler 100 in accordance with the invention is shown in partially cut-away representation in FIG. 1. The muffler 100 comprises a cannister 114 having inlet tube 106 and outlet or exhaust tube 108, and end walls 102 and 104. The interior space of the cannister 114 is divided by at least two lateral walls 110 and 112 which divide the cannister interior into at least three chambers. Lateral wall 112 forms the inlet manifold or chamber 116 with end wall 102. Lateral wall 110 forms the outlet or exhaust manifold chamber with end wall 104. The central sound-attenuating chamber 120 is disposed between lateral walls 110 and 112. In the embodiment depicted, the central sound-attenuating chamber is divided by a third lateral wall 122. Three-element muffler pipes of the invention, depicted in FIG. 2 traverse the lateral walls 110 and 112 of the muffler cannister 114 to permit the passage of exhaust gases through the inlet tube 106 of the muffler and, eventually, out through outlet or exhaust tube 108. One of the three-element tubes 124 passes through lateral wall 112 dividing the inlet manifold chamber 116 from the central sound-attenuating chamber 120. A second pipe 126 passes through the wall 122 diving the central sound-attenuating chamber 120. A third tube 128 passes through lateral wall 110 separating the central sound-attenuating chamber 120 and the outlet or exhaust manifold chamber 118. The arrows indicate the labyrinthine path taken by the gases from the internal combustion engine.

While there have been shown and described what are the preferred embodiments of the invention, one skilled in the art will appreciate that various modifications may be made without departing from the scope of the invention as defined by the appended claims.

What is claimed is:

1. A fibrous sheath of sound absorbing material for use as the sound attenuating element disposed between the outer surface of an inner tubular partially-perforated element and the inner surface of an outer tubular sleeve element of a three-element muffler pipe, the sheath comprising a tubular, porous, resilient mat of compressed and hardened fibrous material having inner and outer surfaces, and a hardening agent, as initially applied, located between the inner and outer surfaces, the inner surface of the sheath fabricated to form a close fit with the outer surface of the inner tubular partially perforated element of the three-element muffler pipe, and the outer surface of the sheath fabricated to form a close fit with the inner surface of the outer tubular sleeve element of the three-element muffler pipe.

2. A fibrous sheath of sound absorbing material as defined in claim 1 wherein the inner and outer surfaces define circular cylinders.

3. A fibrous sheath of sound absorbing material as defined in claim 1 wherein the inner and outer surfaces define elliptical cylinders.

4. A fibrous sheath of sound absorbing material as defined in claim 1 wherein one of the inner and outer surfaces of the sheath define a circular cylinder and the other defines an elliptical cylinder.

5. A fibrous sheath of sound absorbing material as defined in claim 1 wherein the fibrous material is selected from the group consisting of filamentous polymer, metal, or glass.

6. A fibrous sheath of sound absorbing material as defined in claim 5 wherein the fibrous material is filamentous polymer.

7. A fibrous sheath of sound absorbing material as defined in claim 6 wherein the fibrous material is filamentous polyethylene.

8. A fibrous sheath of sound absorbing material as defined in claim 6 wherein the fibrous material is filamentous polypropylene.

9. A fibrous sheath of sound absorbing material as defined in claim 5 wherein the fibrous material is filamentous metal.

10. A fibrous sheath of sound absorbing material as defined in claim 9 wherein the fibrous material is filamentous steel.

11. A fibrous sheath of sound absorbing material as defined in claim 9 wherein the fibrous material is filamentous stainless steel.

12. A fibrous sheath of sound absorbing material as defined in claim 5 wherein the fibrous material is filamentous glass.

13. A three-element muffler pipe assembly comprising an inner partially-perforated tubular element, an intermediate sheath of a porous compressed, resilient, hardened fibrous sound absorbing material fitting closely over the inner perforated tubular element, and an outer tubular sleeve element fitting closely over the sheath of fibrous sound absorbing material; the intermediate sheath of porous compressed hardened sound absorbing material, having inner and outer surfaces, formed by wrapping an uncompressed pad of fibrous material having an applied layer of thermal-setting hardening material around a mandrel, such that the hardening material is located between the inner and outer surfaces, subjecting the wrapped mandrel and uncompressed pad to a pressure sufficient to conform the outer shape and dimensions of the compressed sheath thus formed to the shape and inner dimensions of the outer sleeve element of the muffler pipe assembly, and heating the mandrel and compressed sheath to a temperature sufficient to set the hardening material.

14. A three-element muffler pipe assembly as defined by claim 13 wherein the inner partially-perforated tubular element and the outer tubular sleeve element are of circular cross-section.

15. A three-element muffler pipe assembly as defined by claim 13 wherein one of the inner partially-perforated tubular element and the outer tubular sleeve element is of circular cross-section and the other is of elliptical cross-section.

16. A three-element muffler pipe assembly as defined by claim 13 wherein the inner partially-perforated tubular element and the outer tubular sleeve element are of elliptical cross-section.

17. A three element muffler pipe assembly as defined by claim 13 wherein the intermediate sheath of porous compressed hardened sound absorbing material comprises glass wool.

18. A three element muffler pipe assembly as defined by claim 17 wherein the hardening material comprises metal salts of silicic acid.

19. A sound attenuating muffler comprising an outer canister having first and second end walls, and lateral walls dividing the canister into at least three compartments or chambers comprising an inlet manifold chamber, a central sound-attenuating chamber, and an outlet manifold chamber; at least one sound attenuating pipe extending from the inlet manifold chamber through an aperture in the dividing lateral wall between the inlet manifold chamber and the central sound-attenuating chamber and into the central sound-attenuating chamber; and at least one sound attenuating pipe extending from the central sound attenuating chamber through an aperture in the dividing lateral wall between the central sound attenuating chamber and the outlet manifold chamber into the outlet manifold chamber; each of the pipes comprising a three element muffler pipe having an inner partially-perforated tubular element, an intermediate sheath of a porous compressed, resilient, hardened fibrous sound absorbing material fitting closely over the inner perforated tubular element, and an outer tubular sleeve element fitting closely over the sheath of fibrous sound absorbing material, the intermediate sheath of porous compressed hardened sound absorbing material formed by wrapping an uncompressed pad of fibrous material having an applied layer of thermal-setting hardening material around a mandrel, subjecting the wrapped mandrel and uncompressed pad to a pressure sufficient to conform the outer shape and dimensions of the compressed sheath thus formed to the shape and inner dimensions of the outer sleeve element of the muffler pipe assembly, and heating the mandrel and compressed sheath to a temperature sufficient to set the hardening material.

20. A sound attenuating muffler as defined by claim 19 wherein the compressed sheath comprises a porous, fibrous pad of polymer, metal or glass.

21. A sound attenuating muffler as defined by claim 20 wherein the compressed sheath comprises a polymer.

22. A sound attenuating muffler as defined by claim 21 wherein the polymer is polyethylene.

23. A sound attenuating muffler as defined by claim 21 wherein the polymer is polypropylene.

24. A sound attenuating muffler as defined by claim 21 wherein the polymer is polytetrafluoroethylene.

25. A sound attenuating muffler as defined by claim 20 wherein the compressed sheath comprises metal wool.

26. A sound attenuating muffler as defined by claim 25 wherein the compressed sheath comprises steel wool.

27. A sound attenuating muffler as defined by claim 25 wherein the compressed sheath comprises stainless steel wool.

28. A sound attenuating muffler as defined by claim 20 wherein the compressed sheath comprises glass wool.

* * * * *

UNITED STATES PATENT AND TRADEMARK OFFICE

CERTIFICATE OF CORRECTION

PATENT NO. : 6,138,791
DATED : October 31, 2000
INVENTOR(S) : Daniel Edward Zanzie It is certified that error appears in the above-identified patent and that said Letters Patent is hereby corrected as shown below:

Title page,
Item [74], *Attorney, Agent, or Firm*, please add -- Jerry F. Janssen --

Signed and Sealed this

Thirtieth Day of December, 2003

JAMES E. ROGAN
*Director of the United States Patent and Trademark Office*